United States Patent [19]

Brochier

[11] Patent Number: 4,777,986

[45] Date of Patent: Oct. 18, 1988

[54] DEVICE FOR VARYING THE DENSITY OF WARP THREADS IN A WEAVING LOOM

[75] Inventor: Jacques Brochier, Lyons, France

[73] Assignee: J. Brochier Soieries, Rhone, France

[21] Appl. No.: 92,983

[22] Filed: Sep. 4, 1987

[30] Foreign Application Priority Data

Sep. 5, 1986 [FR] France ..... 86 12884

[51] Int. Cl.[4] ..... D03C 3/38

[52] U.S. Cl. ..... 139/86

[58] Field of Search ..... 139/85, 86

[56] References Cited

U.S. PATENT DOCUMENTS 1,150,396 8/1915 Seckler ..... 139/86

FOREIGN PATENT DOCUMENTS 140500 6/1902 Fed. Rep. of Germany ..... 139/86
201132 4/1907 Fed. Rep. of Germany ..... 139/86
836474 4/1952 Fed. Rep. of Germany ..... 139/86
595641 10/1959 Italy ..... 139/86

*Primary Examiner*—Henry S. Jaudon
*Attorney, Agent, or Firm*—Browdy and Neimark

[57] ABSTRACT

A device applicable to weaving looms comprises a combination of an individual system of controlling each warp thread through an adjustable position on its support, and a series of guide boards arranged essentially parallel to each other and oriented essentially parallel to the warp threads, each board having several holes for the passage of a corresponding number of control threads for the warp threads, these boards being mounted on their support so as to make it possible to adjust their number and spacing.

8 Claims, 4 Drawing Sheets

DEVICE FOR VARYING THE DENSITY OF WARP THREADS IN A WEAVING LOOM

FIELD OF THE INVENTION

The present invention relates to weaving, and more particularly to a device to vary the density of warp threads in a weaving loom.

BACKGROUND

In a weaving loom, the warp threads, which are parallel to each other and define a warp, are connected to means which permit their selective displacement perpendicularly to the plane of the fabric being woven so that the woof threads may be introduced between the warp threads that are raised and those that are not, thus defining the filling or woof.

The displacement of the warp threads is accomplished by means of control threads, each of which is provided at its bottom with a loop through which a warp thread is passed, its opposite top end being fixed to a hook at the bottom of a driving element which controls the movement of the control thread. At present the machines have a fixed capacity and a number of control hooks limited to 1,344. This number is insufficient for weaving fine threads so that several control threads intended to be raised at the same moment have to be connected to the same control hook.

The set of control threads, or harness, can be in the form of a straight harness 2 as shown in FIG. 1 in the case of the straight-fall mechanism shown in the FIG. 1 drawing, or a helix 3 as shown in FIG. 2 in the case of a lateral fall to the left or right. The connecting control threads 4 between the control hooks 5 and the loops about the warp threads pass through a guide board 6, i.e. a board that has holes 7 for the passage of each control thread 4, thus assuring that the control threads are kept in order and are aligned with the corresponding warp thread. The guide board determines the density of the weave.

Each warp thread is moreover subject to the action of spring or elastic pull-backs which are fixed on a hook beam and situated, with respect to the layer of warp threads, on the opposite side of where the control threads are situated. These pull-backs assure that each warp thread returns to its initial position when the force exerted on it by the control thread ceases to act.

If a modification is introduced to the guide board for the purpose of changing the density of the weave, while maintaining the same harness, it is found as shown in FIG. 3 that the straightness of the warp is changed, making it impossible to weave. FIG. 3 represents a fixed control block 8 of driving elements and two possible arrangements of the control threads 4 resulting from two ways of employingthe guide board 6. As seen from the drawing, the warp threads in the first configuration (shown the the dash-dot line) are in the same plane. However, in the second configuration, represented by a dashed line, the warp threads are disposed along a curved surface, preventing the filling threads from being introduced.

Only a special type of mounting with two or three superimposed guide boards permits deviations in the density of the weave of up to 15 to 20%.

If one wishes to change the density of the weave, it is therefore necessary to completely redo the set-up, which represents a considerable cost per installed control thread; it is further necessary to put the loom out of production for several weeks, which amounts to a serious loss of production.

SUMMARY OF THE INVENTION

The present invention is intended to remedy these disadvantages by providing an apparatus that will permit the density of the weave to be changed simply and rapidly for each type of cloth to be woven without dismantling the harness.

For that purpose, this apparatus combines an individual system for control of each warp thread through an adjustable position on a support and a series of small guide boards arranged essentially parallel to the warp threads, each guide board providing a number of holes for the passage therethrough of a corresponding number of control threads for the warp threads, these guide boards being mounted on their support so as to make it possible to adjust their number and their spacing.

As a result of this structure it is possible to change the density of the weave while using the same control harness by simultaneously modifying the position of the control hooks and/or the number and arrangement of the guide boards in order to keep the warp in the same plane.

An advantage of the invention is that the control hooks are grouped on a certain number of modules, each module being locked adjustably in the desired position on a solid support on the frame of the loom, and that each guide board provides a certain number of holes for passage therethrough of the control threads, this number being a submultiple of the number of hooks on one module.

This results in all the control threads joined to one module being governed by a whole number of guide boards. As it turns out, the number of hooks on one module is desirably 576, while the number of holes arranged on one guide board is desirably 96.

Another characteristic of the invention is that each guide board is suitably 9.6 mm wide. This provides, insofar as a dozen boards are arranged together for the guidance of 1,152 control threads joined to two modules, permitting a weave density of 100 threads per centimeter to be obtained. In such a configuration, the modules should be grouped in pairs and arranged head-to-foot.

In order to decrease the density of the weave, it is necessary only to separate the guide boards and to shift the modules on their supports so as to decrease the angles formed thread to thread between the boards and the hooksoof the modules. This permits an acceptable straightness to be maintained in the warp. This arrangement permits working with a thread density of between 100 to 46.8 threads per centimeter.

In order to weave the cloth with a density of less than 46.8 threads per centimeter, it is necessary only to mount the modules in line, i.e. parallel to each other on the same support with the separation between the boards being adjusted.

In accordance with another characteristic of the invention, the means for pulling back the warp threads consist of boards situated underneath the layer of warp threads and occupying the same arrangement as the guide boards. For this purpose, these boards are made adjustable on their support, and the support itself is made movable vertically with the use of a jack between a first position corresponding to the work position in which the control threads are tight, and a second or relaxed position. This relaxed position is a position which is adopted prior to the aforementioned adjustments to effect change in the density of the weave.

The guide boards and the pull-back boards may be adjusted in different ways, as for instance by engaging the ends of the boards in the slots provided at spaces determined on two scales, by mounting between the guide boards struts of a length corresponding to the distance desired between two guide boards, or by mounting the boards on their support through the use of a means of measurement and means of locking (by a screw or eccentric, for example).

BRIEF DESCRIPTION OF DRAWING

In any case the invention will be clearly understandable by means of the following description with reference to the attached schematic drawings, which represent (with the exception of FIGS. 1–3) two forms of construction of this apparatus, same being non-limitative examples.

DETAILED DESCRIPTION OF EMBODIMENTS

In the device made according to this invention each control thread 4 is joined to an independent control hook. These hooks (not shown in FIGS. 8 and 9) are grouped on modules 9, each module 9 having 576 hooks distributed in 24 plates of 24 hooks each. These modules will be described below, along with how they are mounted on their respective supports.

Figure 1:
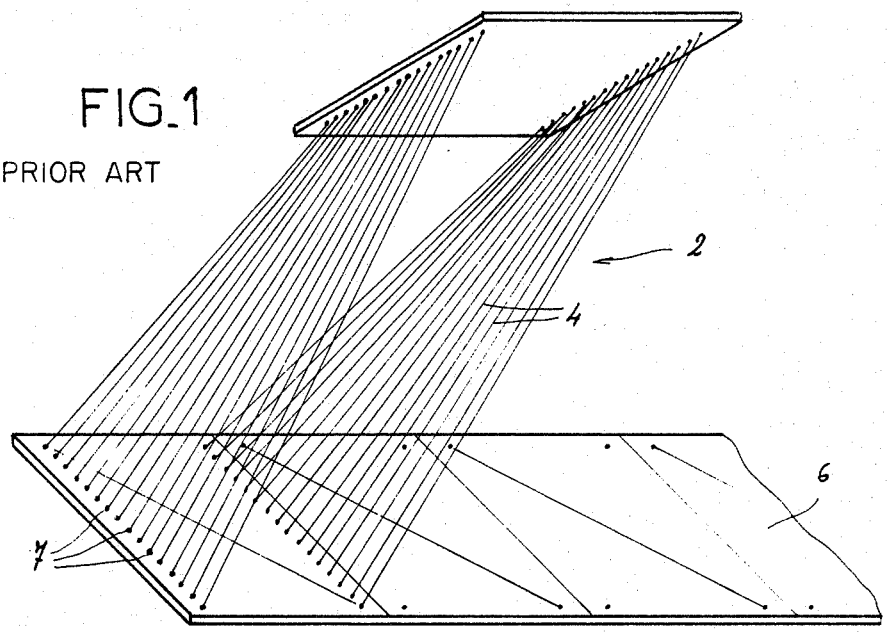
FIG. 1 PRIOR ART
FIGS. 1 and 2 are schematic view of prior art arrangements.
Figure 2:
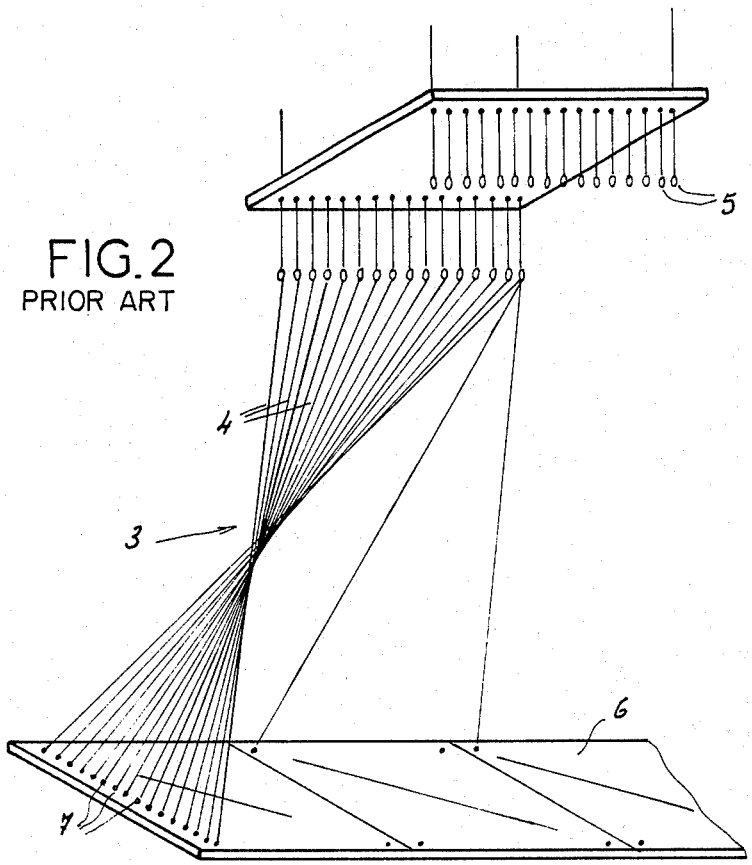
FIG. 2 PRIOR ART
Figure 3:
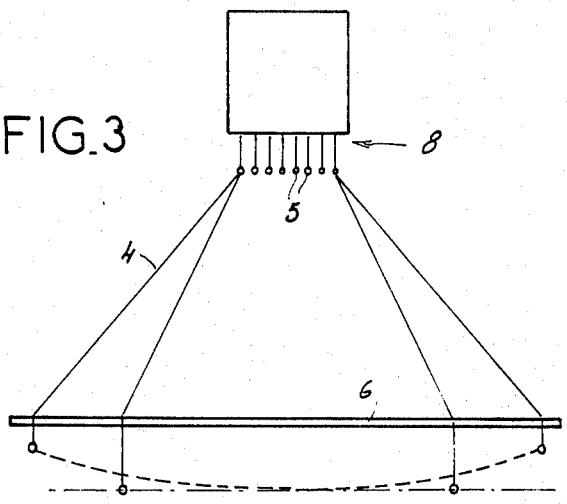
FIG. 3 is a schematic illustration of an unsatisfactory option.
Figure 4:
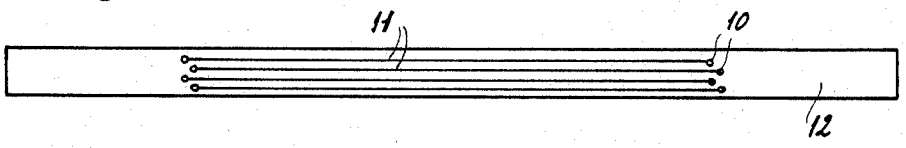
FIG. 4 is a top view of a guide board for use in the present invention.

Each control thread 4 passes through a hole 10 set into a guide board 12 as shown in FIG. 4. Each guide board 12 is 9.6 mm wide and has 93 holes 10 arranged in four parallel lines 11 as schematically shown in FIG. 4, each line being about 120 mm long. A certain number of boards, depending on the width of the cloth and the density of the warp threads, are arranged parallel to each other in the direction of the warp threads.

Figure 6:
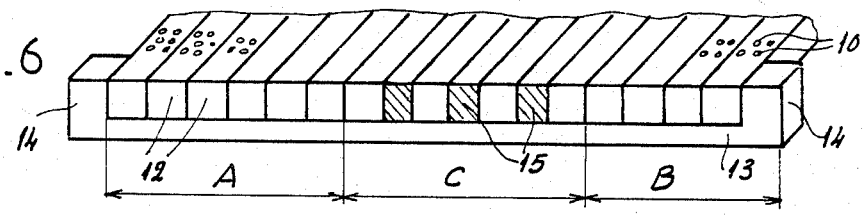
FIGS. 6 and 7 are two views in perspective of two devices in accordance with the invention to position and hold the guide or pull-back boards.

In the device as shown in FIG. 6, the boards 12 are located on a guide frame 13 with two block stops 14 on its ends. On the lateral parts A and B of each guide 13, the boards 12 are next to each other, which corresponds to a maximum thread density. On the other hand, in the central part C, the guide boards 12 are kept separate from each other by insert boards 15 which enables a lower density of warp threads to be obtained.

Figure 7:
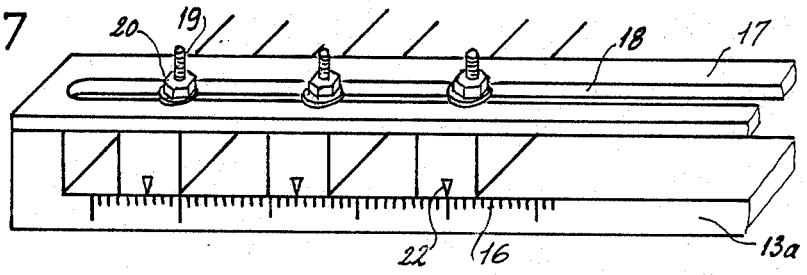

In the apparatus as represented in FIG. 7, the guide frame **13*a* has a graduated scale 16 and is equipped with a locking mechanism 17 provided with a longitudinal opening 18. Each guide board 12*a* is provided with a threaded rod 19 which enables it to be locked onto the plate 17 with a nut 20 after the position of each board 12*a* has been adjusted according to index marks 22 placed along the scale 16**.

Figure 5:
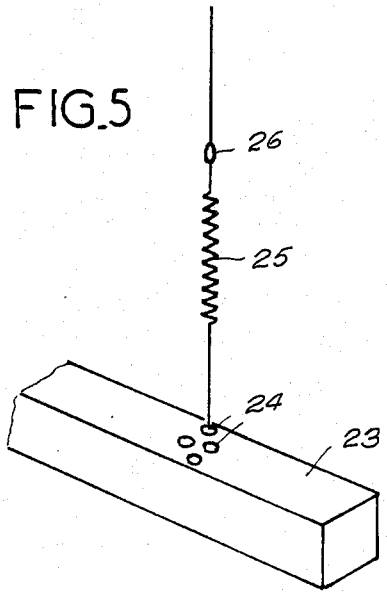
FIG. 5 is a view of the device for use in the present invention for pulling back a warp thread.

The arrangements described above for the guide boards are also applicable to the pull-back boards 23, which are situated under the warp and each of which should occupy a position corresponding to that of a guide board. Noting FIG. 5, the pull-back boards 23 have holes 24 for the passage therethrough of pull back threads 25, acting as elastic pieces, one end of each being fixed to the loop 26 through which the wrap thread passes and the movement of which is effected by a specific control thread 4. It should be noted that the various pull-back threads 25 are mounted on the same support 27 and that this support may be moved vertically with the use of a jack 28 between a work position in which the warp threads are pulled back and an adjustment position in which the pull back threads are relaxed.

Figure 8:
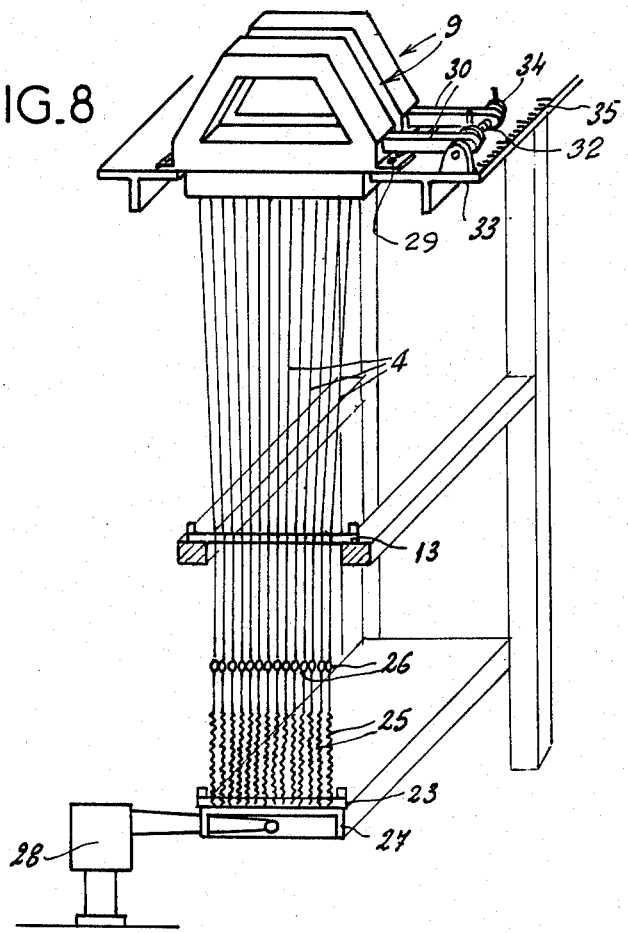
FIGS. 8 and 9 are two side views of two devices made in accordance with this invention.

FIG. 8 represents an apparatus intended to make cloth with a warp of low or medium density, i.e. less than 46.8 threads per centimeter. In this case, a certain number of modules 9, depending on the width of the cloth being made, are arranged in line, i.e. parallel to each other on the same support.

Figure 9:
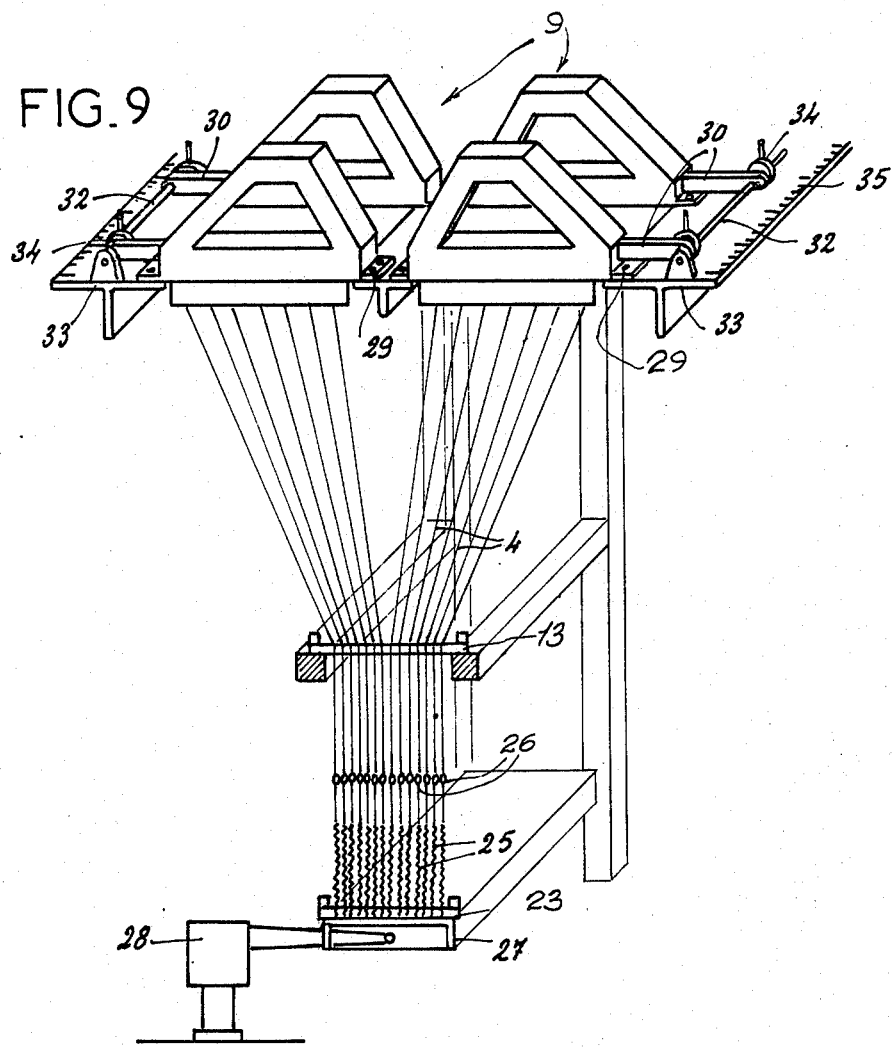

It should be noted that the separation between these modules 9 can be adjusted after loosening attachments 29 of each module and sliding a solid arm 30 of the module on a solid shaft 32 of a fixed support 33. The arms 30 of the various modules 9 5 can be locked onto the shaft 32 with an eccentric 34, and the position of each module can be determinedwwith precision because of a graduated scale 35 on the support 33. To make cloth with a warp density greater than 46.8 threads per centimeter up to 100 threads per centimeter, the modules are grouped in pairs, the two modules of the same pair being arranged head-to-foot, as shown in FIG. 9. In this case, two control shafts 32 should be provided, one for each module series.

To change the density of the warp threads, the pull-backs 25 should first be put in a relaxed position with the jack 28, each module should be loosened from the control shaft in order to bring it into the desired position, the guide 12 and pull-back 23 boards should be positioned, the reed should be changed because the reed is the element that determines the width of the cloth, and finally it should be assured that the pull-backs 25 for the warp threads are tightened. It should be noted that this operation is carried out simply and rapidly with no modification of the harness, which is a factor in its economy and speed.

As can be seen from the above, this invention greatly improves the existing technology by providing an apparatus that is simple in concept. This invention has been described above for manual operation but can be very easily automated. It goes without saying that the invention is not limited only to the forms of apparatus described above as examples; on the contrary, it encompasses all the variants that might be built. For example, the number of hooks per module can be different, as well as the number of holes in the guide and pull-back boards, without departing in any way from the framework of the invention.

What is claimed is:

1. A device associated with a weaving loom for simply and rapidly changing the density of the weave comprising means for controlling the height of each warp thread including a control thread having a loop at its lower end for encircling the warp thread; a first adjustable support for said control thread; and a second support and series of guide boards arranged essentially parallel to each other and oriented essentially parallel to the warp threads, each board having several holes for the passage therethrough of a corresponding number of said control threads, said boards being adjustably mounted on said second support so as to permit adjustment of the number and spacing of said boards on said support.

2. A device in accordance with claim 1, wherein said control threads are grouped to extend downwardly from a certain number of modules, each said module being mounted on a said first adjustable support so that it may be adjusted and locked in a desired position on said support relating to the frame of the loom; and each guide board having a predetermined number of holes for the passage therethrough of the control threads, this number of holes being a submultiple of the number of hooks on one module.

3. A device in accordance with claim 2, wherein the number of control threads on one module is 576 while the number of holes provided in one guide board is 96.

4. A device in accordance with claim 3, wherein the width of each guide board is 9.6 mm.

5. A device in accordance with claim 1, further comprising means for pulling back the warp threads opposite said control threads, said means consisting of pull-back boards situated underneath the warp and occupying the same relative position as the guide boards located thereabove, said pull-back boards being mounted in a support so they may be adjusted on their support, said support itself being mounted for vertical movement between one position corresponding to the work position in which the control threads are tight, and another relaxed position.

6. A device in accordance with claim 5, wherein the means of adjusting the guide boards and the pull-back boards on their respective supports consist of scaled supports having notches situated at predetermined spacings from each other to engage the ends of the boards.

7. A device in accordance with claim 5, wherein the means of adjusting the guide boards and the pull-back boards on their respective supports consist of insert boards (15) of a predetermined width placed between the guide and pull-back boards as a function of the density of the weave to be made.

8. A device in accordance with the group of claims 1 through 5, wherein the means of adjusting the guide boards and the pull-back boards consist of a means of indexing (16, 22) the position of each board on its support and means of locking the position of each board on its support **(13*a*) with the use of a screw (18, 20)**.

* * * * *